United States Patent [19]

von Braunhut

[11] Patent Number: 4,808,138

[45] Date of Patent: Feb. 28, 1989

[54] BUBBLE MAKING DEVICE

[76] Inventor: Harold von Braunhut, P.O. Box 809, Bryans Road, Md. 20616

[21] Appl. No.: 120,349

[22] Filed: Nov. 13, 1987

[51] Int. Cl.[4] ..... A63H 33/28

[52] U.S. Cl. ..... 446/16

[58] Field of Search ..... 446/15-21, 446/490

[56] References Cited

U.S. PATENT DOCUMENTS

| | | | |
|---|---|---|---|
| 2,631,404 | 3/1953 | Clausen | 446/16 |
| 2,832,173 | 4/1958 | Winfield | 446/16 |
| 2,858,639 | 11/1958 | Lawrence | 446/16 |
| 4,125,959 | 11/1978 | Markiw | 446/17 |
| 4,654,017 | 3/1987 | Stein | 446/15 |

OTHER PUBLICATIONS

"An Ephemeral Sculpture Machine" by Felix T. Cartagena, Jun. 1986.

"Bubbles" by Bernie Zubrowski, pp. 18, 19, Little, Brown and Co., 1979.

*Primary Examiner*—Mickey Yu

*Attorney, Agent, or Firm*—Helfgott & Karas

[57] ABSTRACT

A bubble-making device, includes a container with an opening, and a removable cover for closing the opening in the container in liquid sealing relation. A pair of cords extend from the underside of the cover in spaced apart relation when the cover is withdrawn, the cords engaging a retractor mechanism in the container which keeps the cords tensioned while maintaining them in spaced apart relation. A separate cord joins the pair of cords near the underside of the cover. When the container is filled with a film making liquid and the cover is withdrawn with the cords, by bending the pair of cords against a long edge of the container opening a film is formed between the cords and the opening edge. A giant bubble may then be formed by holding the film against a wind.

25 Claims, 2 Drawing Sheets

BUBBLE MAKING DEVICE

BACKGROUND OF THE INVENTION

1. Field of the Invention

The present invention relates generally to bubble-making devices, and particularly to such a device in which the bubble film forming components are portable and includes extendable parts retractable into a container which holds a film forming solution.

2. Description of the Known Art

Toy bubble makers of the kind in which a small plastic loop is immersed in a jar of soapy water solution are well known. In use, the loop is withdrawn from the jar with a surface film formed within the loop opening. When the loop is moved quickly through the air or held against a wind, one or more bubbles are produced from the film and float for a while in the air. Recently, it is known to produce large-sized or giant bubbles by immersing a "hoola hoop", or the like, in a bathtub or large container of soapy water and lifting the loop away with a surface soap film formed in its opening. Other relatively large frames may also be immersed in a tub of liquid film forming solution and then withdrawn so that bubbles of great proportions can be produced when the film formed in the hoop or frame opening is exposed to air movement.

So far as is known, no device has been proposed which can be carried relatively easy on a person such as in a pocket, or worn on the person, but will allow giant bubbles to be created without the need for large and bulky hoops or frames. Also no portable device is known for making bubbles which carries its own reservoir of film forming material. Additionally, heretofore bubble making was based on isolating a fixed quantity of film within a boundary and then converting the film into a bubble shape. No additional or continuous supply of the liquid was fed into the film to enlarge the bubble as it is being shaped.

SUMMARY OF THE INVENTION

An object of the invention is to provide a bubble-making device of relatively small dimensions but nonetheless, capable of producing bubbles previously obtained only with large hoops or frames.

Another object of the invention is to provide a bubble-making device for producing giant bubbles, the device being small enough to be worn or carried in a pocket.

Yet a further object of the present invention is to provide a bubble-making device which is portable and carries its own reservoir of film making solution for making bubbles.

Still a further object of the present invention is to form a bubble by continuously feeding additional film-making solution to the film boundaries to permit extrusion of a giant bubble not limited by the size of the device.

According to the invention, a bubble making device includes a container for holding a film-making solution, the container having an opening with a closable cover. A pair of flexible cords extend from an underside of the cover to form opposite side boundaries of a film when the cover is withdrawn from the container. Cord retractor means serves to retract the pair of cords back into the container when the cover is placed over the opening, and to maintain the cord taut and in spaced apart relation when the cover is withdrawn. Film edge defining means fixed between the pair of cords in the region of the cover, form an end boundary for the film extending between the opposite side boundaries defined by the pair of cords. Accordingly, when the container is filled with a film making solution and the cover is drawn from the container, a film is formed within the boundaries defined by the pair of cords, the film edge defining means, and along an edge of the container opening against which edge the cords are held. By allowing a wind to impinge on the film, giant bubbles can be produced as the film lifts off from the boundaries.

In an embodiment of the invention instead of using an edge of the container opening, another film edge defining means can be connected between the cords adjacent the container in opposition to the first such edge defining means.

In another embodiment of the invention, a continuous supply of the film making solution is fed to the boundaries to permit enlargement of the bubble as it is being formed.

The various features of novelty which characterize the invention are pointed out with particularity in the claims annexed to and forming a part of the present disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
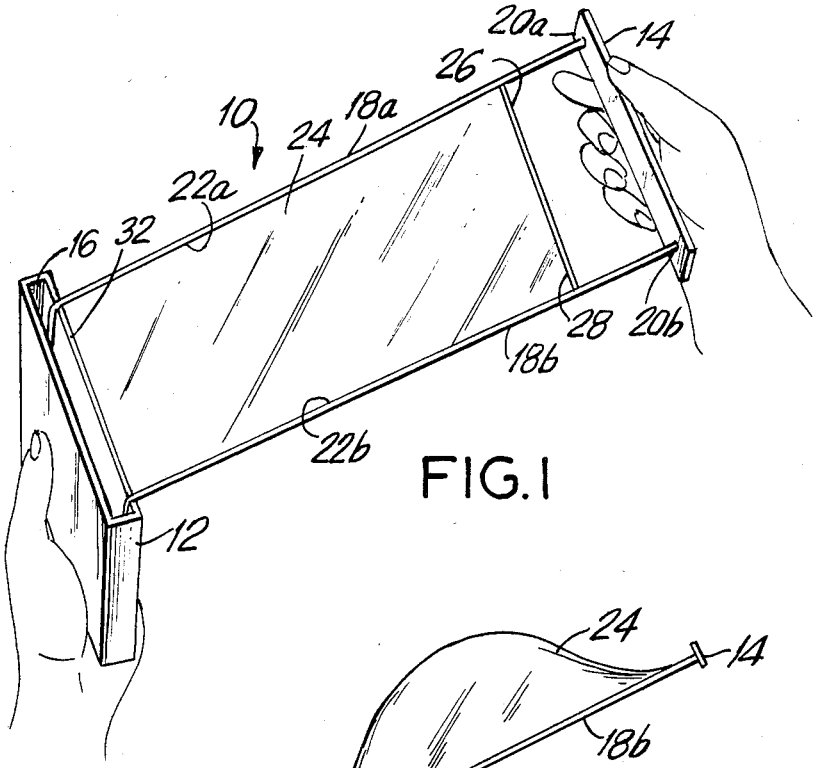
FIG. 1 is a perspective view of a bubble making device according to the invention, as used to produce a film between the boundaries of the device.

FIG. 1 is a perspective view of a bubble-making device 10 according to the invention. The device 10 is shown to include a generally rectangular container 12 which may be molded of plastic material, for holding a film making liquid such as a soapy water solution. The container 12 can be of such dimensions as to be held in one hand as shown, or stored in a pocket. The shape of the container could also be varied and could include a circular shape, an oval shape, etc. The film forming solution could include additives to prevent the solution from becoming stale, and could include perfumes, etc. The film making liquid is stored in the container 12 without splashing out by means of a top cover 14 seated within a top opening 16 of the container 12. The top cover 14 can be molded of the same material which forms the container 12.

A pair of flexible cords or wires 18*a*, 18*b* each have one end fixed to an underside of the top cover 14, as at 20*a*, 20*b*. The cords 18*a*, 18*b* should allow the film to adhere to them, and not deteriorate when immersed in the film making solution over a long period of time.

As shown in the figures, the pair of cords 18*a*, 18*b*, extend in parallel spaced-apart relation to one another from the underside of the top cover 14. When the top cover is withdrawn from the container opening and extended from the container, the withdrawal of the cords draws with it some film making solution which forms a film making surface. The film surface extends between the two cords which form opposite side boundaries 22*a*, 22*b* to the surface film 24. A third cord 26 is fixed between the pair of cords 18*a*, 18*b* in the vicinity of the underside of the top cover 14, to form an end boundary 28 of the surface film 24 which boundary 28 extends between the opposite side boundaries 22*a*, 22*b* defined by the pair of cords 20*a*, 20*b*. The cover is withdrawn straight out of the container with the cords also being pulled straight out to the extent desired. The cords are then bent relative to the container so that the cords fold onto an edge of the container opening. This edge 32 then forms the fourth boundary of the film surface.

Figure 2:
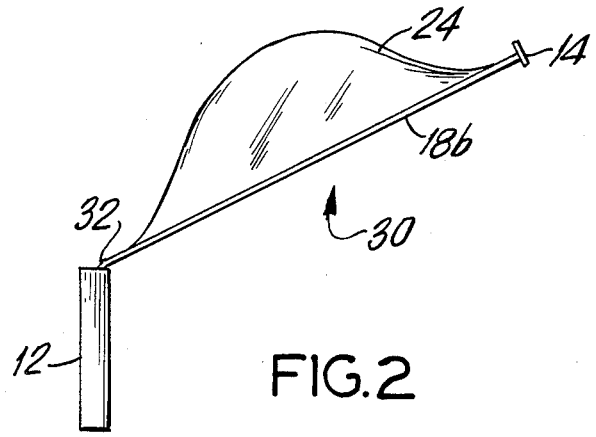
FIG. 2 is a side view of the device in FIG. 1, showing commencement of the formation of a bubble.
Figure 3:
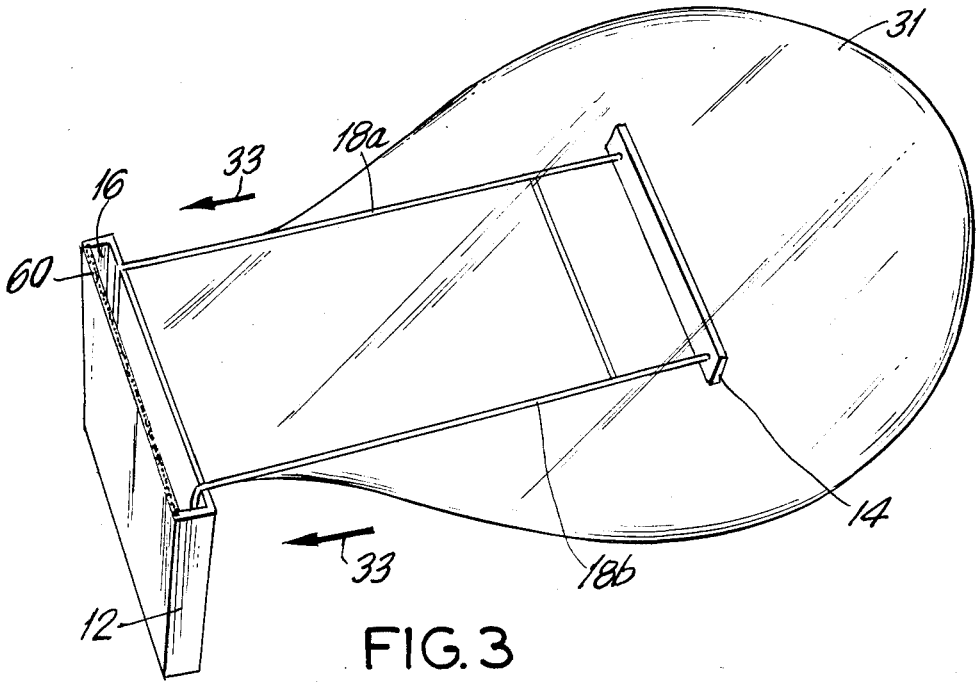
FIG. 3 is a perspective view of the device as in FIG. 1, showing a bubble floating up from the present device.

Referring now to FIGS. 2 and 3, the formation of a bubble from the film will be described. The handle 14 with the boundaries of the film surface and the film extending between such boundaries is typically held at an angle with respect to the container. The film is then placed so that it is in front of a flow of wind, as shown by the arrow 30. The film will then begin to flow up into a bubble form as the wind extends into the film surface. To facilitate extrusion of the film surface into a bubble 31, as shown in FIG. 3, the handle 14 can be slightly released so that the cords 18*a* and 18*b*, move inwardly along the arrows 33 back into the container. This will permit slack in the film surface to facilitate the formation of the large bubble and maintain the film intact without breaking or cracking of the film in the formation of the bubble.

Figure 10:
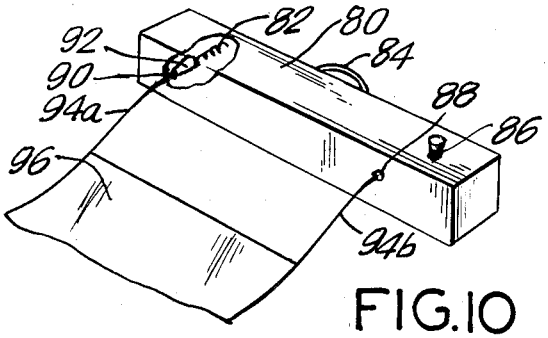
FIG. 10 is a perspective view of the underside of the cover showing the use of an auxiliary reservoir in the cover which is controlled by release valves.

In order to facilitate the continuous extrusion of such bubble, to attain a size greater than the maximum film strength would normally permit, additional film forming fluid can be provided in the cover which feeds onto the cords as the bubble is being formed. As shown in FIG. 10, a cover 80 includes an internal auxiliary reservoir 82 with a handle 84. A plug type opening 86 is available for insertion of a film forming liquid into the reservoir in the cover. A pair of openings 88, 90, are provided which are normally closed off by valves such as spring loaded valves 92, as shown, or mechanical valves, etc. The cords 94*a* and 94*b* extend from the openings and can be used to control the valves. Alternately, other mechanical means can be used to control the valves.

In operation, the valves can be opened to permit some of the fluid stored in the reservoir in the cover to drip down along the cords 94*a*, 94*b* in order to provide additional fluid to feed the film 96 as the film is being extruded into a bubble. This can permit bubbles to be formed which are not limited by the size of the device or the size of the boundaries.

Using the device of the present invention, gigantic bubbles can be made, which size can be that of a car, or larger. It should be appreciated, that such large size bubbles can be achieved even though the device itself is small enough to be hand held and the cords may only extend for about 1½–2 feet.

Figure 4:
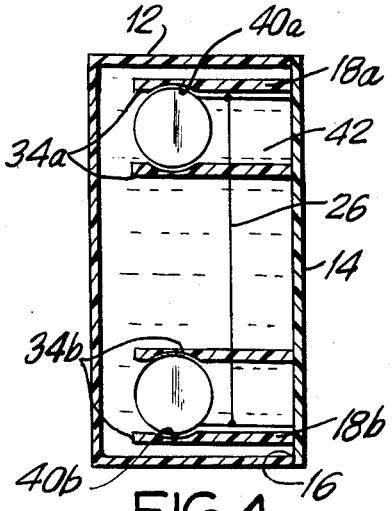
FIG. 4 is a sectional view showing roll-up reels removably fixed in a container part of the device of FIG. 1.

In one embodiment represented in FIG. 4 a pair of spring loaded roll-up reels 40*a*, 40*b* are supported inside the container 12 by sets of ribs 34*a*, 34*b* which can be molded integrally with the container 12. The ribs of each set may have mutually facing detents or arcuate seats for releasably retaining the roll-up reels 40*a*, 40*b* and, moreover, the ribs may be resiliently deformible so as to allow the reels 40*a*, 40*b* to be removed for repair or replacement. As shown in FIG. 4, when the top cover 14 is seated in the top opening 16 of the container 12, both flexible cords 18*a*, 18*b*, are retracted by the roll-up reels 40*a*, 40*b* in the container 12 which contains the film forming solution 42. The solution 42 can include an additive to prevent rusting or other detriment to the reels 40*a* and 40*b*.

Figure 6:
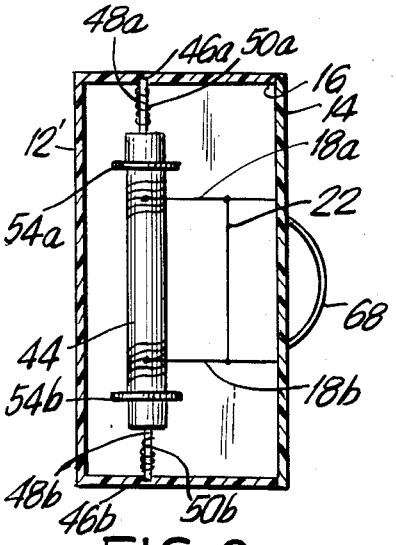
FIG. 6 is a sectional view as in FIG. 4, but showing a single roller in place of separate roll-up reels.
Figure 7:
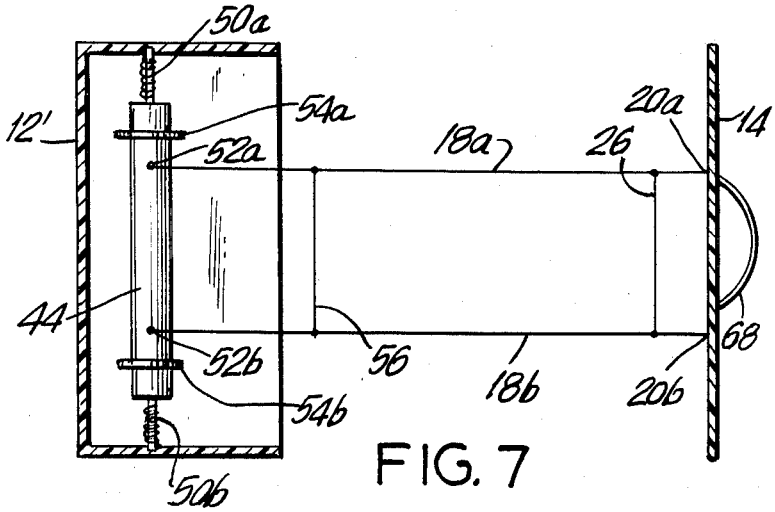
FIG. 7 is a sectional view as in FIG. 6 but showing the cover of the container in a fully extended position.
Figure 8:
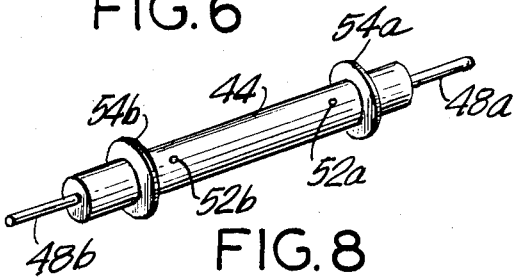
FIG. 8 is a perspective view of the roller shown in FIGS. 6 and 7.

As an alternative to the pair of roll-up reels 40*a*, 40*b*, a single roller 44 may be employed, as shown in FIGS. 6–9. Like the roll-up reels 40*a*, 40*b*, the roller 44 is spring loaded so as to operate to retract the pair of flexible cords 18*a*, 18*b*, when the cover 14 is seated in the container top opening 16. The container 12' is similar to the container 12 of the first embodiment, except for the omission of the rib sets 34*a*, 34*b*. Instead, container 12' has a pair of recesses 46*a*, 46*b* into which are seated the pivot shafts 48*a*, 48*b* at the axial ends of the roller 44. To enable easy removal of the roller 44 from the container 12' for purposes of repair or replacement, the pivot shafts 48*a*, 48*b* may be arranged to be retractable within the roller 44 in response to an axially applied force. A pair of coil springs 50*a*, 50*b* or rubberbands are arranged on the pivot shafts 40*a*, 40*b* as shown in FIGS. 6 and 7 with one end of the springs or bands fixed to an associated end of the roller 44 and the opposite ends of the springs or bands engaging the inner wall surfaces of the container 12'. Springs or bands 50*a*, 50*b* thus are wound about the pivot shafts 40*a*, 40*b* when the top cover 14 is withdrawn from the seated position shown in FIG. 6 to an extended position as in FIG. 7.

Also shown in FIG. 7 there are small opening 52*a*, 52*b* in the circumference of the roller 44, within which openings are secured the ends of the flexible cords 18*a*, 18*b* opposite the cord ends fixed to the top cover at 20*a*, 20*b*. Roller 44 also includes a pair of annular flanges 54*a*, 54*b* near the axial ends of the roller 44 for limiting the axial travel of the cords 18*a*, 18*b* as the cords are wound about the circumference of the roller 44.

The embodiment of FIGS. 6–9 allows the provision of a fourth flexible cord 56 (FIG. 7) to serve as the fourth film edge defining means between the cords 18*a*, 18*b* rather than use the edge of the container opening. The cord 56 is a determined distance from the cord 26 when the flexible cords 18*a*, 18*b* are drawn straight out of the container 12' by the top cover 14. Cord 56 thus forms a second end boundary of the film surface which boundary extends between the cords 18*a*, 18*b* and is spaced opposite from the end boundary formed by the cord 26 by the predetermined distance.

Figure 5:
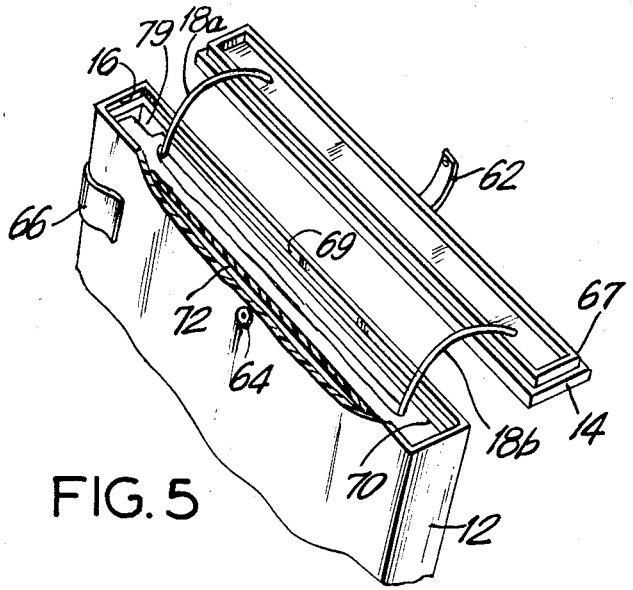
FIG. 5 is an enlarged perspective view of the device of FIG. 1 showing various modifications.
Figure 9:
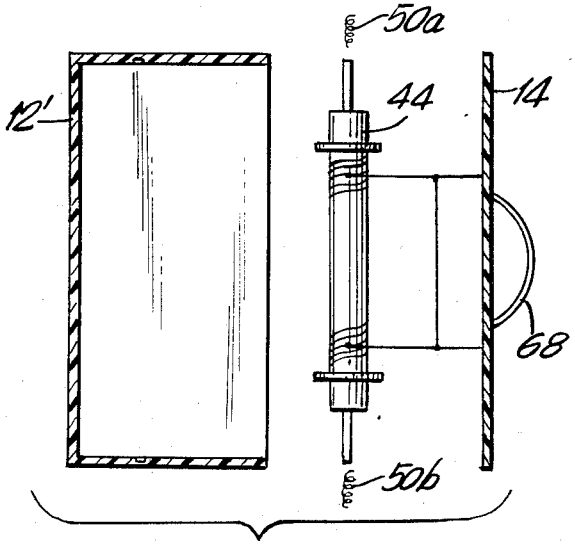
FIG. 9 is a view similar to FIGS. 6 and 7 but representing the removal of the roller from the container.

Various modifications will be apparent to one skilled in the art. For example, a foam strip 60 may be placed along a long edge of the container 12 adjacent the top opening 16 as shown in FIG. 3. Strip 60 is for purposes of cleaning and drying the flexible cords 18*a*, 18*b* when the cords are brought into moving contact with the foam strip 60. Also, as shown in FIG. 5, a fastener strap 62 can be fixed medially of the top cover 14, to engage a catch 64 on a side wall of the container 12, to hold the top cover 14 in a closed position over the top opening 16 of the container 12. Further, a clip can be secured medially along a side edge of the container 12, for securing the container to an article of clothing such as a pocket panel or a belt. A handle 68 also may be fixed centrally on the top surface of the cover 14, as shown in FIGS. 6, 7 and 9, to facilitate withdrawn of the cover 14 from the container 12 when a film is to be formed. The cover can include a raised lip 67 indented from the outer edge which can engage a recessed seat 69 in the opening of the container to form a secure seal for closing the container to prevent any of the liquid from dropping out.

In FIG. 5 a baffle plate 70 is shown seated within the top opening 16 of the container 12. The baffle plate 70 has an elongated slot 72 through which the pair of flexible cords 18*a*, 18*b*, the third cords 26 (not shown) and the fourth cord 56 (if provided) are allowed to pass when the cover 14 is withdrawn from the container 12. The baffle plate 70 is also arranged to prevent liquid in the container 12 from splashing out of the top opening 16. A pouring spout 79 is provided for filling the container with the liquid.

The particular structure shown are done so by way of examples. Other equivalent structure could be utilized to provide for the closure, the sealing, and other aspects of the invention. Likewise, the particular shape can be modified so that it will be flat and the roll up reels can be of the type where the cord is pulled from the axial center of the roll up reel. This would permit a flat round or oval shaped type of container with the two flat roll up reels placed along the base.

While specific embodiment of a bubble-making device according to the invention have been described above, variations obvious to those skilled in the art may be made without departing from the scope of the invention as set forth in the following claims.

I claim:

1. A bubble-making device, comprising:

a container for storing a film making liquid, the container having an opening and including a removable member;

flexible cords having opposing ends, one each of each being coupled to said member, the cords extending in space apart relation to each other to form at least part of the boundaries of a film region when said member is withdrawn from said container;

cord retractor means disposed inside aid container and secured to the opposite end of each of said flexible cords, for retracting the cords into said container when said member is replaced onto said container, and film edge defining means fixed between the flexible cords completing the boundaries of the film region;

wherein when said container comprises film making liquid and said member is withdrawn, a film is formed within said film region which can then be extruded by a flow of air to form a floating bubble.

2. The bubble-making device of claim 1, wherein said film edge defining means comprises a flexible cord.

3. The bubble-making device of claim I, comprising foam strip means extending along an edge of said opening for cleaning said flexible cords when the cords are brought into moving contact with the foam strip means.

4. The bubble-making device of claim 1, wherein said cord retractor means comprises a pair of roll-up reels and said container includes support means for securing the reels in spaced apart relation to one another.

5. The bubble-making device of claim 4, wherein said support means comprises means for detachably mounting said reels in said container.

6. The bubble-making device of claim 1, wherein said cord retractor means comprises an elongate roller with pivot shafts at the axial ends of the roller, and said container has means for engaging said pivot shafts.

7. The bubble-making device of claim 6, including means for enabling said pivot shafts to retract within said roller so that the roller can be removed from said container.

8. The bubble-making device of claim 6, wherein said film edge defining means is adjacent said member and including a further film edge defining means spaced from said film edge defining means in a direction away from said member when the flexible cords are drawn out of said container, said spaced apart edge defining means forming opposing boundaries to the film region.

9. The bubble-making device of claim 8, wherein both said edge defining means comprise flexible cords.

10. The bubble-making device of claim 1, including baffle means fixed in said container in the vicinity of said opening for preventing liquid in said container from surging and forming undesirable foam or microbubbles, and from splashing out of said opening, and including an elongated slot for permitting the flexible cords and said film edge defining means to pass therethrough.

11. The bubble-making device of claim 1, wherein said member comprises a cover for closing onto said opening.

12. The bubble-making device of claim 11, including fastener means for holding the cover in a closed position over the opening of said container.

13. The bubble-making device of claim 1, including clip means on said container for securing the container to an article of clothing.

14. The bubble making device of claim 6, including annular flanges on said roller near its axial ends, for limiting the axial travel of said cords as the cords are wound on the circumference of the roller.

15. The bubble-making device of claim 11, including handle means fixed to a top surface of the cover for facilitating withdrawal of the cover from said container.

16. The bubble-making device of claim 1, and comprising a pair of said cords spaced in substantially parallel relationship when extracted from the container.

17. The bubble-making device of claim 1, and wherein an edge of said opening of said container defines a boundary of the film region.

18. The bubble-making device of claim 10, and further comprising spout means in said baffle means for supplying said liquid into the container.

19. The bubble-making device of claim 1, and comprising reservoir means coupled onto said member for storing at least some of said liquid, control means in said reservoir means for permitting said liquid to drip from said reservoir means onto said flexible cords, and means for selectively operating the control means.

20. The bubble-making device of claim 1, wherein said container is a hand-held unit, and the resulting bubbles are giant bubbles.

21. The bubble-making device of claim 11, and further comprising means for sealing the cover onto the opening to prevent leakage.

22. The bubble-making device of claim 1, wherein said retractor means comprises means for applying a tension in said flexible cords while maintaining the cords in spaced apart relation when said member is withdrawn.

23. A bubble-making device, comprising:

a container for storing a film-making liquid, a frame member removable from said container and defining part of a boundary of a film region, an edge of said container forming the rest of the boundary of the film region, and reactor means in said container for retracting said frame member back into said container, wherein when said container has film making liquid and said frame member is withdrawn, a film of said liquid is formed within said film region which can then be formed into a bubble by a flow of air.

24. A bubble-making device, comprising:

a container for storing a film making liquid, a member having flexible cords coupled thereto and from said container, and means in said container for providing tension on the flexible cords extracted from the container to thereby define a film boundary between the flexible cords, wherein when said container retains the liquid, extraction of the member causes a film to be formed in said boundary which can then be formed into a floating bubble by a flow of air.

25. A bubble-making device, comprising:

a container for storing a film-making liquid, frame means extractable from said container and defining together with an edge of the container a boundary region, whereupon extraction from the liquid, a film of the liquid is formed within the boundary region which can then be made into a bubble by a flow of a air; and supply means for providing additional liquid to the boundary region during the formation of the bubble to thereby form a still larger bubble.

* * * * *

UNITED STATES PATENT AND TRADEMARK OFFICE

CERTIFICATE OF CORRECTION

PATENT NO. : 4,808,138

DATED : February 28, 1989

INVENTOR(S) : von Braunhut

It is certified that error appears in the above-identified patent and that said Letters Patent is hereby corrected as shown below:

Claim 1, line 5 (col.5, line 49). "each" (first occurrence) should read--end--.

Claim 1, line 7 (col.5, line 51). "space" should read--spaced--.

Claim 1, line 10 (col.5, line 54). "aid" should read--said--.

Claim 8, line 2 (col.6, line 19). Add--,-- after "member".

Claim 23, line 7 (col.7, line 15). "reactor" should read--retractor--.

Signed and Sealed this

Thirty-first Day of October, 1989

*Attest:*

*Attesting Officer*

DONALD J. QUIGG

*Commissioner of Patents and Trademarks*